US009114632B2

(12) United States Patent
Deonarine

(10) Patent No.: US 9,114,632 B2
(45) Date of Patent: Aug. 25, 2015

(54) PRINTING RIBBON AND METHOD FOR A RIBBON PRINTING SYSTEM

(71) Applicant: Illinois Tool Works Inc., Glenview, IL (US)

(72) Inventor: Indarjit Deonarine, Schaumburg, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/756,031

(22) Filed: Jan. 31, 2013

(65) Prior Publication Data

US 2014/0210931 A1 Jul. 31, 2014

(51) Int. Cl.

| | |
|---|---|
| ***B41J 2/35*** | (2006.01) |
| ***B41J 2/325*** | (2006.01) |
| ***B41J 35/36*** | (2006.01) |
| ***B41J 17/36*** | (2006.01) |

(52) U.S. Cl.
CPC *B41J 2/325* (2013.01); *B41J 17/36* (2013.01); *B41J 35/36* (2013.01)

(58) Field of Classification Search
USPC ..... 347/176, 211, 214, 215, 217–219, 171, 347/172, 188; 400/120.01, 120.02
See application file for complete search history.

(56) References Cited

U.S. PATENT DOCUMENTS

| | | | | |
|---|---|---|---|---|
| 6,121,987 | A * | 9/2000 | Sasaki et al. | 347/176 |
| 6,152,621 | A * | 11/2000 | Langan | 400/120.02 |
| 7,400,337 | B2 * | 7/2008 | Mindler | 347/217 |
| 2004/0141048 | A1 * | 7/2004 | Revelles | 347/217 |
| 2008/0012928 | A1 * | 1/2008 | Sparer | 347/188 |

* cited by examiner

*Primary Examiner* — Kristal Feggins
(74) *Attorney, Agent, or Firm* — The Small Patent Law Group LLC; Christopher R. Carroll

(57) ABSTRACT

A printing system includes a controller and a ribbon reading device. The controller is configured to control operations of the printing system according to operational parameters. The operational parameters used to control printing of ink from a thermal print ribbon onto one or more target objects by a thermal print head. The ribbon reading device is configured to examine the thermal print ribbon as the thermal print ribbon moves in the printing system. The ribbon reading device examines the thermal print ribbon to determine if the thermal print ribbon is associated with a set of designated operational parameters for the printing system. The controller is configured to use the set of designated operational parameters to control the operations of the printing system when the thermal print ribbon is associated with the set of designated operational parameters.

12 Claims, 4 Drawing Sheets

PRINTING RIBBON AND METHOD FOR A RIBBON PRINTING SYSTEM

BACKGROUND

A variety of printing systems can apply or print images (e.g., graphics, text, or the like) on exterior surfaces of objects. Many of these systems directly engage or contact the exterior surfaces on which the images are printed. For example, a thermal transfer printing process can involve a print ribbon having ink that is transferred onto a target object by applying heat and pressure to the print ribbon as the print ribbon engages the target object. The print ribbon may be provided from an unwind spindle or reel of a printer, where the print ribbon extends through one or more rollers to cause the ribbon to be disposed between a thermal print head and the target object. From this location, the print ribbon may extend through one or more rollers to a windup spindle or reel. The thermal print head applies the heat and pressure to the ribbon in order to transfer ink in the ribbon to the target object. The printer may be associated with settings that are used to control printing on the target object. In many cases, these settings are manually set by operators of the printing systems. As a result, human error can occur in establishing the settings and less-than-optimum printing may result.

BRIEF SUMMARY

In one embodiment, a printing system includes a controller and a ribbon reading device. The controller is configured to control operations of the printing system according to operational parameters. The operational parameters used to control printing of ink from a thermal print ribbon onto one or more target objects by a thermal print head. The ribbon reading device is configured to examine the thermal print ribbon as the thermal print ribbon moves in the printing system. The ribbon reading device examines the thermal print ribbon to determine if the thermal print ribbon is associated with a set of designated operational parameters for the printing system. The controller is configured to use the set of designated operational parameters to control the operations of the printing system when the thermal print ribbon is associated with the set of designated operational parameters.

In one embodiment, a method includes moving a thermal print ribbon through a printing system that applies heat and pressure to the thermal print ribbon to print ink onto one or more target objects, examining the thermal print ribbon as the thermal print ribbon moves in the printing system to determine if the thermal print ribbon is associated with a set of designated operational parameters for the printing system, and controlling the printing system according to the set of designated operational settings when the thermal print ribbon is associated with the set of designated operational parameters.

In one embodiment, a thermal print ribbon includes a backing layer and a substrate layer. The substrate layer includes ink for printing onto one or more target objects when the backing layer is engaged by a thermal print head of a printing system that applies heat and pressure to the backing layer to expel the ink from the substrate layer onto the one or more target objects. At least one of the backing layer or the substrate layer includes bodies of a trace material capable of being detected by a ribbon reading device in the printing system to determine whether designated operational parameters are associated with the thermal print ribbon so that the designated operational parameters are automatically used to control operations of the printing system.

BRIEF DESCRIPTION OF THE DRAWINGS

Reference is now made briefly to the accompanying drawings, in which.

DETAILED DESCRIPTION

Figure 1:
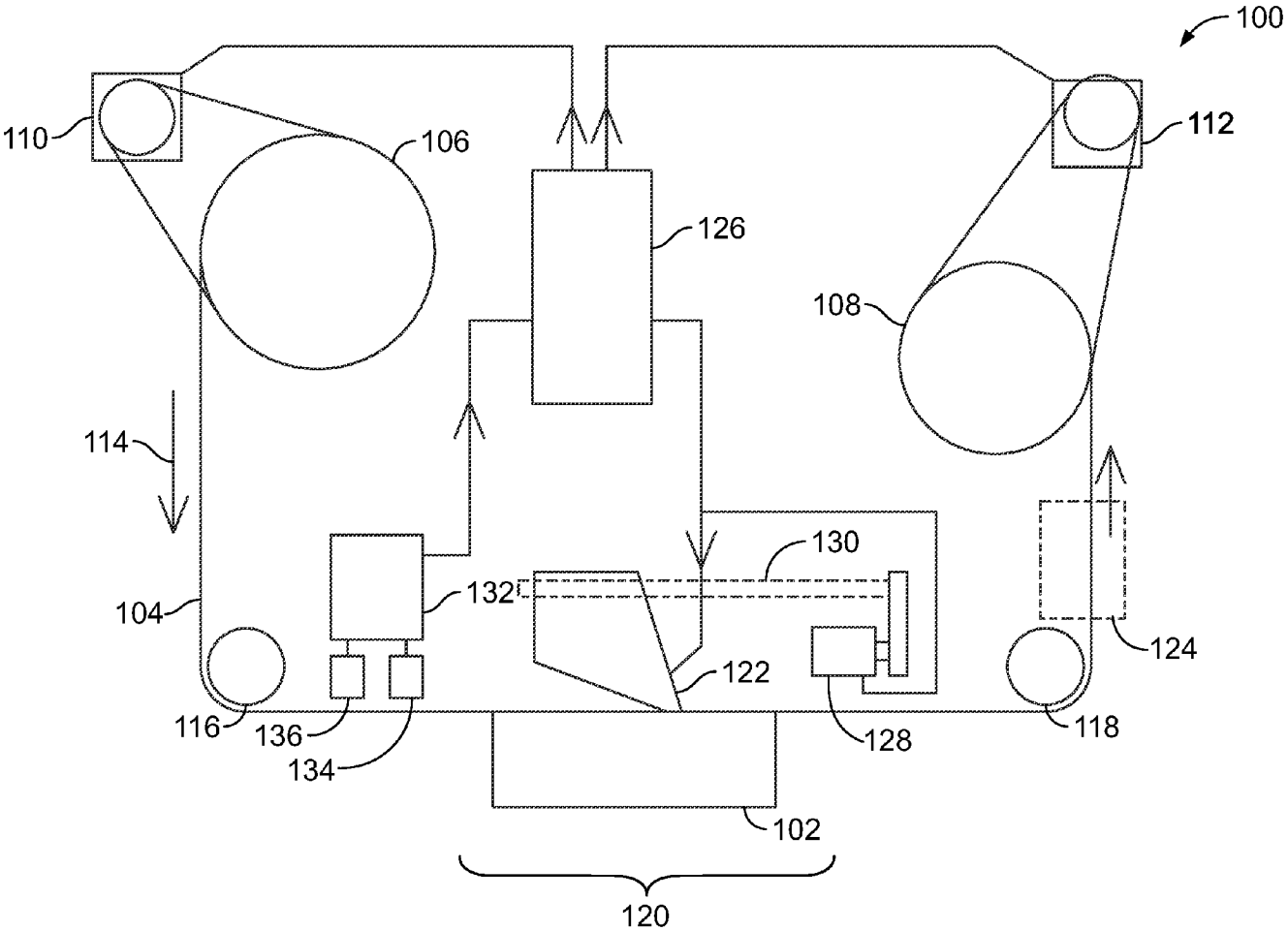
FIG. 1 is a schematic view of one embodiment of a printing system.

FIG. 1 is a schematic view of one embodiment of a printing system 100. The printing system 100 may be a thermal printing system that prints images on exterior surfaces of target objects 102 by applying heat and pressure to a print ribbon 104 that includes ink. The printing system 100 includes an unwind spindle 106 with the ribbon 104 wrapped provided thereon and a windup spindle 108 that also is connected with the ribbon 104. In the illustrated embodiment, the spindles 106, 108 are connected with motors 110, 112 that operate to rotate the spindles 106, 108 and cause the ribbon 104 to move through the printing system 100 along a direction of travel 114.

Movement of the ribbon 104 is directed by rollers 116, 118. The ribbon 104 moves through a printing area 120 where a thermal print head 122 engages the ribbon 104 and presses the ribbon 104 against the target object 102. The print head 122 applies heat and pressure to the ribbon 104 to transfer ink from the ribbon 104 onto the target object 102. A print head drive motor 128 controls movement of the print head 122, such as along a raceway 130, when the print head 122 engages the ribbon 104 to print on the target object 102. The print head drive motor 128 may control the pressure that is applied by the print head 122 onto the ribbon 104, such as by controlling how far the print head 122 moves toward the target object 102 to print on the target object 102.

The ribbon 104 continues to travel toward and be collected on the windup spindle 108. In the illustrated embodiment, a feed roller and tension control apparatus 124 may control tension in the ribbon 104 to prevent slack from developing in the ribbon 104 and/or to prevent the tension in the ribbon 104 from becoming too large and breaking the ribbon 104.

A controller 126 controls operations of the printing system 100. The controller 126 may be embodied in and/or include hardware and associated software (either hard wired or loaded into the hardware) for controlling the printing system 100. The controller 126 may represent one or more processors or other computing devices that perform operations described herein. For example, the controller 126 may be communicatively coupled (e.g., wirelessly and/or by one or more wired connections) to the motors 110, 112 to control the relative speeds, accelerations, and/or decelerations at which the motors 110, 112 operate, to control the torques applied to the ribbon 104 by the motors 110, 112, or the like. The controller 126 can be communicatively coupled with the print head drive motor 128 to control the speed, acceleration, and/or deceleration of the print head 122 along the raceway 130, as well as the distance and/or direction that the print head 122 moves along the raceway 130. The controller 126 may be communicatively coupled with the print head 122 (and/or heating elements in the print head 122) to control the temperature to which the print head 122 is heated for printing on the target object 102.

In the illustrated embodiment, the printing system 100 includes a ribbon reading device 132. As described below, the reading device 132 can remotely examine the ribbon 104 to determine which settings of the printing system 100 are to be used to print on the target object 102. By "remotely examine," it is meant that the reading device 132 can obtain information from the ribbon 102 without engaging or otherwise touching the ribbon 104. Alternatively, the reading device 132 may engage or touch the ribbon 104 to acquire this information. The settings that are obtained from reading the ribbon 104 include operational parameters of the printing system 100. These operational parameters can be settings of the printing system 100 that are established for improved printing with the ribbon 104. For example, using the operational parameters read from the ribbon 104 to print using the ribbon 104 can provide for improved printing (e.g., crisper lines, less blurry or out of focus lines or images, more complete images or text, or the like) relative to using one or more different operational parameters for printing with the same ribbon 104.

Examples of these operational settings can include the speed at which the ribbon 104 is moved through the printing system 100, the torque applied to the ribbon 104 as the ribbon 104 is moved through the printing system 100, the temperature of the print head 122, the speed that the print head 122 is laterally moved relative to the target object 102, the direction that the print head 122 is moved relative to the target object 102, the distance that the print head 122 is moved relative to the target object 102, and the pressure applied by the print head 122.

In one embodiment, the ribbon 104 is doped with a trace material, such as a magnetically susceptible ferrite material, that can be detected by the reading device 132. The reading device 132 can include a reader 134 that magnetically obtains the operational parameters (or data representative of or associated with the operational parameters) for the ribbon 104. For example, the trace material in the ribbon 104 may be at least partially magnetized, such as by a writer 136 of the reading device 132 that is disposed upstream of the reader 134. The trace material may be partially magnetized in that portions of the ribbon 104 with the trace material are magnetized while other portions are not such that a pattern similar to Morse code, a bar code, or the like, is created. Alternatively, at least some of the trace material may be magnetized without forming a pattern. The reader 134 may then read the pattern or magnetized portion by detecting changes in the magnetism of the ribbon 104. For example, the reader 134 can apply an electromagnetic field across or toward the ribbon 104 and detect changes in the electromagnetic field to determine if the ribbon 104 includes a magnetized portion and/or if the magnetized portion of the ribbon 104 represents a pattern.

The trace material may be another type of material. For example, the trace material may be a radioactive material, an optically reflective or refractive material, or the like. The radioactivity of the trace material or the reflective or refractive properties of the material may be used to detect the trace material.

The presence of the magnetized portion and/or the pattern that is identified in the ribbon 104 may be communicated to the controller 126. The controller 126 may determine if a set of operational parameters (which may be stored in an internal or external memory of the controller 126) is associated with the magnetized portion and/or the pattern. For example, the controller 126 may obtain a set of operational parameters for the printing system 100 when a magnetized portion in the ribbon 102 is detected, regardless of whether the magnetized portion is formed in a pattern. As another example, the controller 126 may determine if a detected pattern in the ribbon 104 is associated with a set of operational parameters stored in the memory. If so, the controller 126 may obtain the set of operational parameters from the memory. The operational parameters may then be used to control the printing system 100 during printing with the ribbon 104. When another ribbon 104 is used, the process may be repeated to obtain additional or different operational parameters, or to allow the operator to manually input the operational parameters (if the ribbon 104 does not include the trace material).

Figure 2:
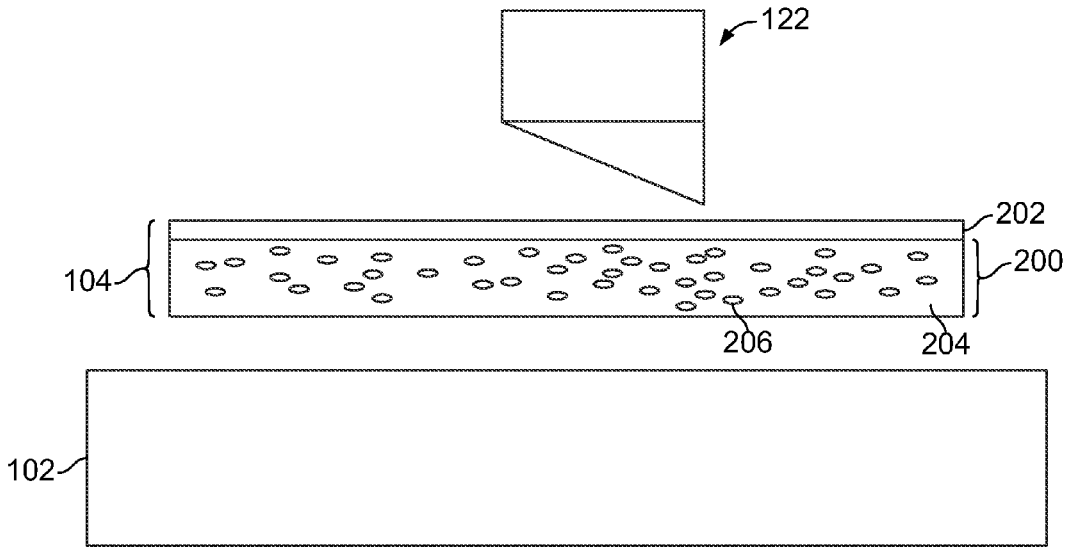
FIG. 2 is a schematic diagram of one embodiment of the ribbon shown in FIG. 1.

FIG. 2 is a schematic diagram of one embodiment of the ribbon 104. In the illustrated embodiment, the ribbon 104 includes plural layers, including a substrate layer 200 and a backing layer 202. The substrate layer 200 may be the portion of the ribbon 104 that includes ink for printing onto the target object 102 by the print head 122. The backing layer 202 may be a protective layer that protects the substrate layer 200 from damage by the print head 122. The backing layer 202 may include wax, a resin, or other type of material. In the illustrated embodiment, the substrate layer 200 includes a fluid ink 204 with smaller bodies 206 of a trace material dispersed therein. The substrate layer 200 may be a flexible body that is saturated with the ink 204.

Figure 3:
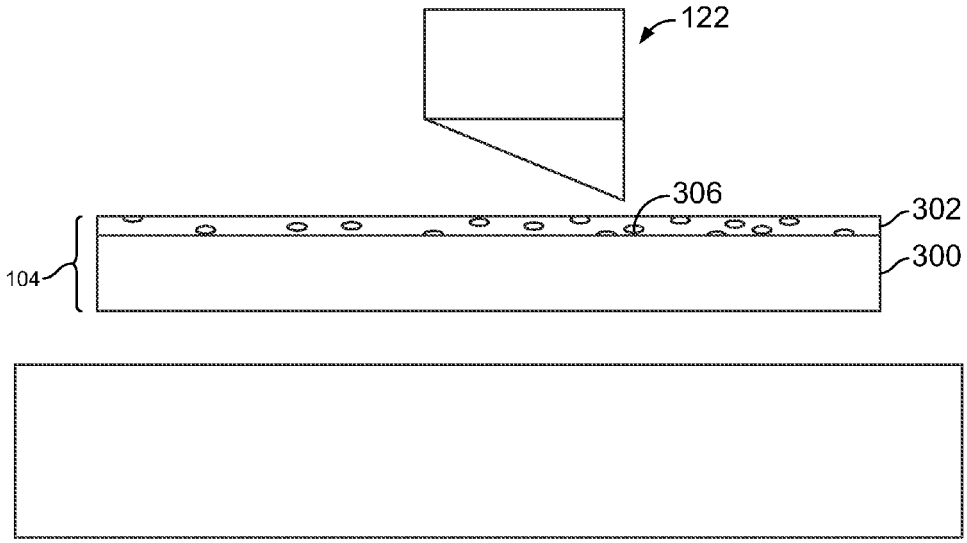
FIG. 3 is a schematic diagram of another embodiment of the ribbon.

FIG. 3 is a schematic diagram of another embodiment of the ribbon 104. In the illustrated embodiment, the ribbon 104 includes plural layers, including a substrate layer 300 and a backing layer 302, similar to the substrate layer 200 and backing layer 202 described above. One difference is that bodies 306 of a trace material are dispersed in the backing layer 302.

Figure 4:
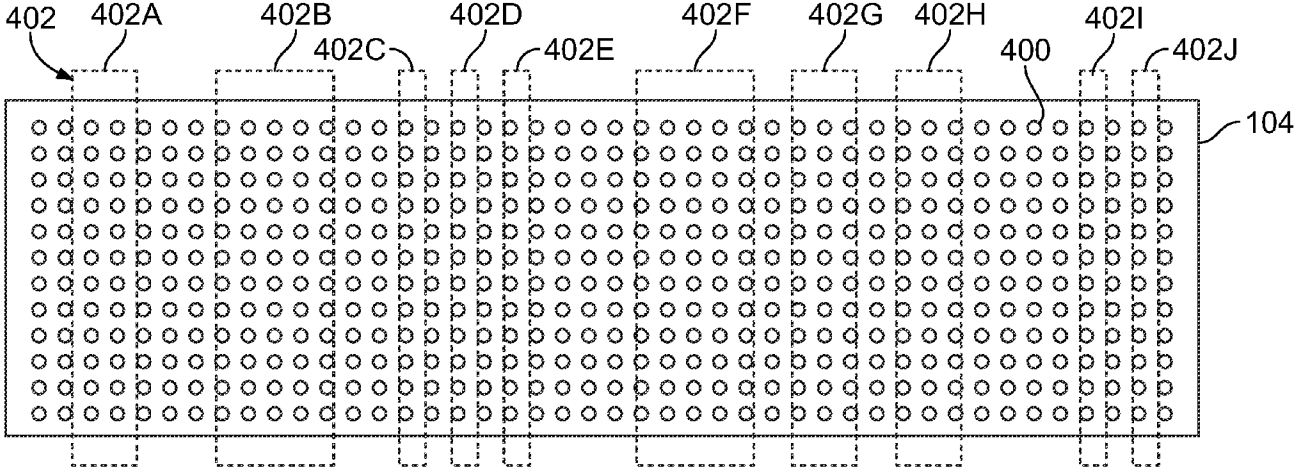
FIG. 4 is a schematic diagram of the ribbon prior to the ribbon being partially magnetized by the writer of the reading device 132 shown in FIG. 1.

FIG. 4 is a schematic diagram of the ribbon 104 prior to the ribbon 104 being partially magnetized by the writer 136 of the reading device 132 shown in FIG. 1. The ribbon 104 is shown with a regular array of bodies 400 of a trace material, such as a magnetically susceptible ferrite material. Although the bodies 400 are shown in a regular array, the bodies 400 may be provided in a non-regular arrangement, such as in a random or pseudo-random arrangement. Prior to passing by the writer 136 of the reader device 132, the bodies 400 may be demagnetized, such as by not exhibiting a relatively strong magnetic north as a group. The writer 136 may selectively magnetize the bodies 400 located in selected segments 402 (e.g., segments 402A-J) of the ribbon 104. For example, the writer 136 may direct a relatively strong electromagnetic field toward the ribbon 104 during time periods that correspond to when each of the different segments 402 are positioned at or near the writer 136. The writer 136 may not direct the electromagnetic field when the portions of the ribbon 104 outside of the segments 402 are positioned at or near the writer 136.

Figure 5:
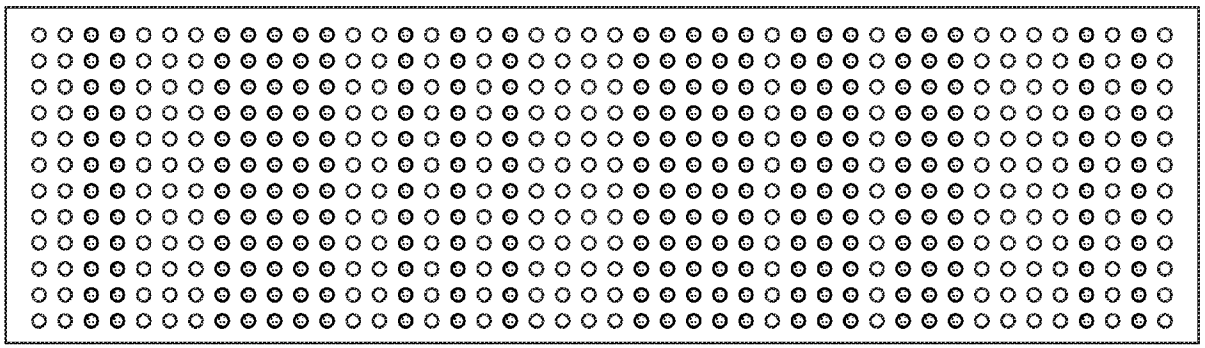
FIG. 5 is a schematic diagram of the ribbon after the ribbon is partially magnetized by the writer of the reading device shown in FIG. 1.

FIG. 5 is a schematic diagram of the ribbon 104 after the ribbon 104 is partially magnetized by the writer 136 of the reading device 132 shown in FIG. 1. Exposure of the bodies 400 to the electromagnetic field may magnetize the bodies 400 in the segments 402 of the ribbon 104. As shown in FIG. 5, the darkened bodies 400 represent magnetized bodies 400 (e.g., bodies 400 which, as a group, exhibit a detectable net magnetic north pole) while the other bodies 400 represent those bodies 400 that are not magnetized by the writer 136.

The relative sizes and spacing between the different groups of magnetized bodies 400 in the ribbon 104 may be detected by the reader 134. For example, the reader 134 may emit an electromagnetic field (different from the field used to magnetize the bodies 400) and measure changes to the electromagnetic field and/or reflections of the electromagnetic field due to the presence, size, and/or spacing of the groups of magnetized bodies 400. The reader 134 can identify a pattern of these groups based on the changes and/or reflections of the electromagnetic field. This pattern (or data representative of or associated with the pattern) may be communicated to the controller 126 in order for the controller 126 to select operational parameters to use with the printing system 100 to control printing with the ribbon 104. For example, different patterns may be associated with different sizes, spacings, and/or sequences of the groups of magnetized bodies 400. These patterns can be associated with different operational parameters, as described above. The controller 126 can decide which operational parameters to use based on which pattern is identified.

In another embodiment, the writer 136 may magnetize a group of the bodies 400 without forming a pattern. The reader 134 may then detect the group of magnetized bodies 400 and notify the controller 126. The controller 126 may then automatically use operational parameters associated with the ribbon 104 (such as the operational parameters associated with a particular manufacturer of the ribbon 104 and that is identified by the group of magnetized bodies 400).

In another embodiment, the bodies 400 in the ribbon 104 may be magnetized in a group and/or in a pattern without the writer 136 changing the magnetism of the bodies 400. For example, the ribbon 104 may be purchased or otherwise acquired with a group and/or pattern of magnetized bodies 400 being formed therein, without the writer 136 having to magnetize the bodies 400.

Figure 6:
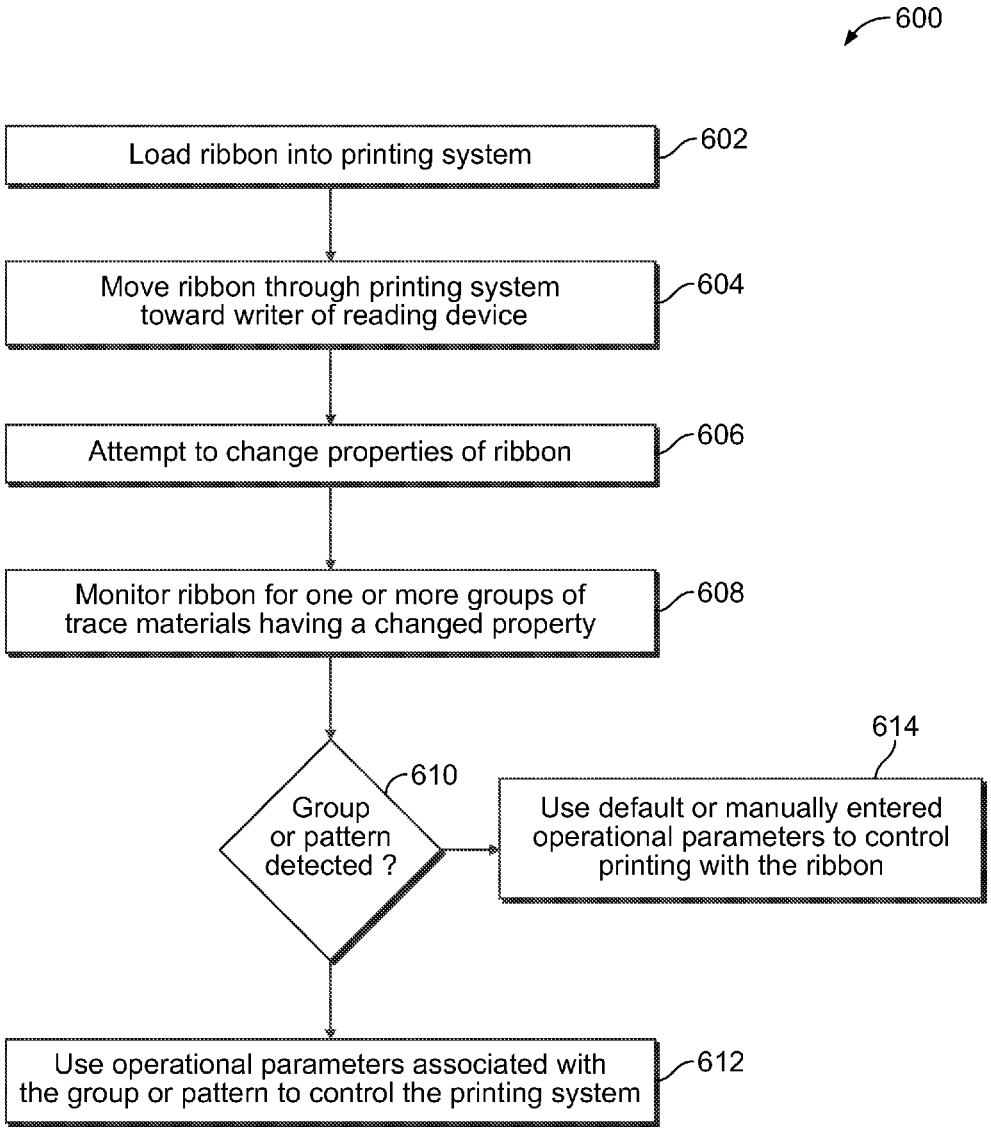
FIG. 6 is a flowchart of one embodiment of a method for controlling a printing system.

FIG. 6 is a flowchart of one embodiment of a method 600 for controlling a printing system. The method 600 may be practiced by one or more embodiments of the printing system 100 shown in FIG. 1. At 602, the ribbon 104 is loaded into the printing system 100. The ribbon 104 may include a trace material dispersed in the ink of the ribbon 104, in the backing layer of the ribbon 104, or in another location of the ribbon 104.

At 604, the ribbon 104 is moved through the printing system 100 toward the writer 136 of the reading device 132. For example, the motors 110 and/or 112 may turn the spindles 106 and/or 108 to move the ribbon 104 through the printing system 100. At 606, an attempt is made to change one or properties of the ribbon 104. For example, the writer 136 may expose the ribbon 104 to one or more magnetic fields in an attempt to magnetize one or more groups of ferrite trace material in the ribbon 104, as described above. If the ribbon 104 includes the trace material (such as when the ribbon 104 is provided by a particular manufacturer of print ribbons), then one or more properties of the trace material becomes changed, such as by magnetizing one or more groups of the trace material, as described above. If, on the other hand, the ribbon 104 does not include the trace material, then no properties of the ribbon 104 may be changed.

At 608, the ribbon 104 is monitored for the one or more groups of trace materials having a changed property. For example, the reader 134 may periodically examine, continuously examine, or examine the ribbon 104 in an on-demand (e.g., manually selected or non-periodic) basis. The reader 134 can expose the ribbon 104 to an electromagnetic field to determine if one or more groups of trace material in the ribbon 104 have been magnetized, as described above. As another example, the reader 134 may optically scan the ribbon 104 to determine if optical properties of the trace material have changed. As another example, the reader 134 may examine radiological properties of the ribbon 104 to determine if the trace materials exhibit any radioactive properties. Alternatively, another technique may be used by the reader 134 to determine whether the ribbon 104 includes the trace materials.

At 610, a determination is made as to whether a group or pattern of groups of trace materials is detected. For example, a decision may be made as to whether the reader 134 identified a group of magnetic trace materials or a pattern of groups of magnetic trace materials. If such a group or pattern is identified, then the group or pattern may indicate that the ribbon 104 includes the trace material and is associated with a set of operational parameters to be used in the printing system 100 to improve printing with the ribbon 104. As a result, flow of the method 600 proceeds to 612. On the other hand, no such group or pattern is identified, then the absence of the group or pattern may indicate that the ribbon 104 does not include the trace material and/or is not associated with a set of operational parameters to be used in the printing system 100 to improve printing with the ribbon 104. As a result, flow of the method 600 proceeds to 614.

At 612, the operational parameters associated with the group or pattern that is identified are used to control the printing system 100. For example, the ribbon 104 from a particular manufacturer may be associated with a set of operational parameters that are used to control the printing system 100 in order to provide for improved printing with the ribbon 104 relative to using one or more other operational parameters. These operational parameters may be automatically loaded and used in the printing system 100, without requiring operator intervention. Alternatively, the operational parameters may be presented to the operator for the operator to approve of implementation and use of the operational parameters. Printing with the ribbon 104 may then proceed with the operational parameters.

At 614, default operational parameters or manually entered operational parameters are used to control printing with the ribbon 104 in the printing system 100. Because the ribbon 104 is not identified as including the group or pattern of trace materials, no operational parameters that are associated with the ribbon 104 are automatically used. For example, the ribbon 104 may not be from a designated manufacturer of print ribbons that has the designated operational parameters associated with the manufacturer. As a result, default and/or manually entered operational parameters are used, which may result in poorer printing relative to using a ribbon having the group or pattern of trace materials.

In one embodiment, a printing system includes a controller and a ribbon reading device. The controller is configured to control operations of the printing system according to operational parameters. The operational parameters used to control printing of ink from a thermal print ribbon onto one or more target objects by a thermal print head. The ribbon reading device is configured to examine the thermal print ribbon as the thermal print ribbon moves in the printing system. The ribbon reading device examines the thermal print ribbon to determine if the thermal print ribbon is associated with a set of designated operational parameters for the printing system. The controller is configured to use the set of designated operational parameters to control the operations of the printing system when the thermal print ribbon is associated with the set of designated operational parameters.

In one aspect, the ribbon reading device is configured to examine the thermal print ribbon by determining if the thermal print ribbon includes at least one of a group or a pattern of groups of a magnetic trace material in the thermal print ribbon.

In one aspect, the controller is configured to determine that the thermal print ribbon is associated with the set of designated operational parameters when the at least one of a group or a pattern of groups of the magnetic trace material is found in the thermal print ribbon.

In one aspect, different patterns of the magnetic trace material are associated with different sets of designated operational parameters. The controller is configured to determine which of the sets of designated operational parameters to use to control the printing system based on which of the patterns of the magnetic trace material is found in the thermal print ribbon.

In one aspect, the designated operational parameters include one or more of a speed at which the thermal print ribbon moves through the printing system, a torque at which the thermal print ribbon is pulled through the printing system, an acceleration of the thermal print ribbon in the printing system, a deceleration of the thermal print ribbon in the printing system, a temperature of the thermal print head that engages the thermal print ribbon to print on the one or more target objects, a pressure at which the thermal print head engages the thermal print ribbon, or a speed at which the thermal print head moves across the thermal print ribbon during printing on the one or more target objects.

In one aspect, the ribbon reading device includes a writer configured to magnetize one or more groups of a trace material disposed in the thermal print ribbon prior to the ribbon reading device examining the thermal print ribbon.

In one embodiment, a method includes moving a thermal print ribbon through a printing system that applies heat and pressure to the thermal print ribbon to print ink onto one or more target objects, examining the thermal print ribbon as the thermal print ribbon moves in the printing system to determine if the thermal print ribbon is associated with a set of designated operational parameters for the printing system, and controlling the printing system according to the set of designated operational settings when the thermal print ribbon is associated with the set of designated operational parameters.

In one aspect, examining the thermal print ribbon includes determining if the thermal print ribbon includes at least one of a group or a pattern of groups of a magnetic trace material in the thermal print ribbon.

In one aspect, the thermal print ribbon is determined to be associated with the set of designated operational parameters when the at least one of a group or a pattern of groups of the magnetic trace material is found in the thermal print ribbon.

In one aspect, different patterns of the magnetic trace material are associated with different sets of designated operational parameters. Controlling the printing system includes determining which of the sets of designated operational parameters to use to control the printing system based on which of the patterns of the magnetic trace material is found in the thermal print ribbon.

In one aspect, the designated operational parameters include one or more of a speed at which the thermal print ribbon moves through the printing system, a torque at which the thermal print ribbon is pulled through the printing system, an acceleration of the thermal print ribbon in the printing system, a deceleration of the thermal print ribbon in the printing system, a temperature of a thermal print head that engages the thermal print ribbon to print on the one or more target objects, a pressure at which the thermal print head engages the thermal print ribbon, or a speed at which the thermal print head moves across the thermal print ribbon during printing on the one or more target objects.

In one aspect, the method also includes magnetizing one or more groups of a trace material disposed in the thermal print ribbon prior to examining the thermal print ribbon.

In one embodiment, a thermal print ribbon includes a backing layer and a substrate layer. The substrate layer includes ink for printing onto one or more target objects when the backing layer is engaged by a thermal print head of a printing system that applies heat and pressure to the backing layer to expel the ink from the substrate layer onto the one or more target objects. At least one of the backing layer or the substrate layer includes bodies of a trace material capable of being detected by a ribbon reading device in the printing system to determine whether designated operational parameters are associated with the thermal print ribbon so that the designated operational parameters are automatically used to control operations of the printing system.

In one aspect, the designated operational parameters include one or more of a speed at which the thermal print ribbon moves through the printing system, a torque at which the thermal print ribbon is pulled through the printing system, an acceleration of the thermal print ribbon in the printing system, a deceleration of the thermal print ribbon in the printing system, a temperature of the thermal print head that engages the thermal print ribbon to print on the one or more target objects, a pressure at which the thermal print head engages the thermal print ribbon, or a speed at which the thermal print head moves across the thermal print ribbon during printing on the one or more target objects.

In one aspect, the bodies of the trace material are configured to be magnetized by a writer of the printing system to permit detection of the trace material.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A printing system comprising:

a controller configured to control operations of the printing system according to operational parameters, the operational parameters used to control printing of ink from a thermal print ribbon onto one or more target objects by a thermal print head; and a ribbon reading device configured to electromagnetically examine the thermal print ribbon as the thermal print ribbon moves in the printing system, the ribbon reading device examining the thermal print ribbon to determine if the thermal print ribbon is associated with a set of designated operational parameters for the printing system, wherein the controller is configured to use the set of designated operational parameters to control the operations of the printing system when the thermal print ribbon is associated with the set of designated operational parameters, wherein the ribbon reading device is configured to examine the thermal print ribbon by determining if the thermal print ribbon includes at least one of a group or a pattern of groups of a magnetic trace material in the thermal print ribbon, and wherein the controller is configured to determine that the thermal print ribbon is associated with the set of designated operational parameters when the at least one of a group or a pattern of groups of the magnetic trace material is found in the thermal print ribbon.

2. The printing system of claim 1, wherein different patterns of the magnetic trace material are associated with different sets of designated operational parameters, and the controller is configured to determine which of the sets of designated operational parameters to use to control the printing system based on which of the patterns of the magnetic trace material is found in the thermal print ribbon.

3. The printing system of claim 1, wherein the designated operational parameters include one or more of a speed at which the thermal print ribbon moves through the printing system, a torque at which the thermal print ribbon is pulled through the printing system, an acceleration of the thermal print ribbon in the printing system, a deceleration of the thermal print ribbon in the printing system, a temperature of the thermal print head that engages the thermal print ribbon to print on the one or more target objects, a pressure at which the thermal print head engages the thermal print ribbon, or a speed at which the thermal print head moves across the thermal print ribbon during printing on the one or more target objects.

4. The printing system of claim 1, wherein the ribbon reading device includes a writer configured to magnetize one or more groups of a trace material disposed in the thermal print ribbon prior to the ribbon reading device examining the thermal print ribbon.

5. A method comprising:

moving a thermal print ribbon through a printing system that applies heat and pressure to the thermal print ribbon to print ink onto one or more target objects;

electromagnetically examining the thermal print ribbon as the thermal print ribbon moves in the printing system to determine if the thermal print ribbon is associated with a set of designated operational parameters for the printing system; and controlling the printing system according to the set of designated operational settings when the thermal print ribbon is associated with the set of designated operational parameters, wherein examining the thermal print ribbon includes determining if the thermal print ribbon includes at least one of a group or a pattern of groups of a magnetic trace material in the thermal print ribbon, and wherein the thermal print ribbon is determined to be associated with the set of designated operational parameters when the at least one of a group or a pattern of groups of the magnetic trace material is found in the thermal print ribbon.

6. The method of claim 5, wherein different patterns of the magnetic trace material are associated with different sets of designated operational parameters, and controlling the printing system includes determining which of the sets of designated operational parameters to use to control the printing system based on which of the patterns of the magnetic trace material is found in the thermal print ribbon.

7. The method of claim 5, wherein the designated operational parameters include one or more of a speed at which the thermal print ribbon moves through the printing system, a torque at which the thermal print ribbon is pulled through the printing system, an acceleration of the thermal print ribbon in the printing system, a deceleration of the thermal print ribbon in the printing system, a temperature of a thermal print head that engages the thermal print ribbon to print on the one or more target objects, a pressure at which the thermal print head engages the thermal print ribbon, or a speed at which the thermal print head moves across the thermal print ribbon during printing on the one or more target objects.

8. The method of claim 5, further comprising magnetizing one or more groups of a trace material disposed in the thermal print ribbon prior to examining the thermal print ribbon.

9. A printing system comprising:

a controller configured to control operations of the printing system according to operational parameters, the operational parameters used to control printing of ink from a thermal print ribbon onto one or more target objects by a thermal print head; and a ribbon reading device configured to examine the thermal print ribbon as the thermal print ribbon moves in the printing system, the ribbon reading device examining the thermal print ribbon to determine if the thermal print ribbon is associated with a set of designated operational parameters for the printing system, wherein the controller is configured to use the set of designated operational parameters to control the operations of the printing system when the thermal print ribbon is associated with the set of designated operational parameters, and wherein the ribbon reading device is configured to examine the thermal print ribbon by determining if the thermal print ribbon includes at least one of a group or a pattern of groups of a magnetic trace material in the thermal print ribbon.

10. A printing system comprising:

a controller configured to control operations of the printing system according to operational parameters, the operational parameters used to control printing of ink from a thermal print ribbon onto one or more target objects by a thermal print head; and a ribbon reading device configured to examine the thermal print ribbon as the thermal print ribbon moves in the printing system, the ribbon reading device examining the thermal print ribbon to determine if the thermal print ribbon is associated with a set of designated operational parameters for the printing system, wherein the controller is configured to use the set of designated operational parameters to control the operations of the printing system when the thermal print ribbon is associated with the set of designated operational parameters, and wherein the designated operational parameters include one or more of a speed at which the thermal print ribbon moves through the printing system, a torque at which the thermal print ribbon is pulled through the printing system, an acceleration of the thermal print ribbon in the printing system, a deceleration of the thermal print ribbon in the printing system, a temperature of the thermal print head that engages the thermal print ribbon to print on the one or more target objects, a pressure at which the thermal print head engages the thermal print ribbon, or a speed at which the thermal print head moves across the thermal print ribbon during printing on the one or more target objects.

11. A method comprising:

moving a thermal print ribbon through a printing system that applies heat and pressure to the thermal print ribbon to print ink onto one or more target objects;

examining the thermal print ribbon as the thermal print ribbon moves in the printing system to determine if the thermal print ribbon is associated with a set of designated operational parameters for the printing system; and controlling the printing system according to the set of designated operational settings when the thermal print ribbon is associated with the set of designated operational parameters, wherein examining the thermal print ribbon includes determining if the thermal print ribbon includes at least one of a group or a pattern of groups of a magnetic trace material in the thermal print ribbon.

12. A method comprising:

moving a thermal print ribbon through a printing system that applies heat and pressure to the thermal print ribbon to print ink onto one or more target objects;

examining the thermal print ribbon as the thermal print ribbon moves in the printing system to determine if the thermal print ribbon is associated with a set of designated operational parameters for the printing system; and controlling the printing system according to the set of designated operational settings when the thermal print ribbon is associated with the set of designated operational parameters, wherein the designated operational parameters include one or more of a speed at which the thermal print ribbon moves through the printing system, a torque at which the thermal print ribbon is pulled through the printing system, an acceleration of the thermal print ribbon in the printing system, a deceleration of the thermal print ribbon in the printing system, a temperature of a thermal print head that engages the thermal print ribbon to print on the one or more target objects, a pressure at which the thermal print head engages the thermal print ribbon, or a speed at which the thermal print head moves across the thermal print ribbon during printing on the one or more target objects.

* * * * *